US006038815A

United States Patent [19]

Manini

[11] Patent Number: 6,038,815

[45] Date of Patent: Mar. 21, 2000

[54] GATE MOVEMENT DRIVE

[75] Inventor: Michelangelo Manini, Bologna, Italy

[73] Assignee: FAAC S.p.A., Italy

[21] Appl. No.: 09/014,390

[22] Filed: Jan. 27, 1998

[30] Foreign Application Priority Data

Jan. 29, 1997 [IT] Italy ..... MI970051 U

[51] Int. Cl.[7] ..... E05F 15/20

[52] U.S. Cl. ..... 49/31; 49/380

[58] Field of Search ..... 49/138, 31, 340, 49/380; 318/461, 466

[56] References Cited

U.S. PATENT DOCUMENTS

| | | | |
|---|---|---|---|
| 4,429,264 | 1/1984 | Richmond | 318/466 |
| 5,351,440 | 10/1994 | Vincent | 49/340 |
| 5,386,885 | 2/1995 | Bunzl et al. | 185/40 R |
| 5,703,452 | 12/1997 | Futsuhara | 318/558 |
| 5,729,101 | 3/1998 | Richmond et al. | 318/282 |
| 5,804,938 | 9/1998 | Richmond et al. | 318/282 |
| 5,869,940 | 2/1999 | Parsadayan | 318/461 |

FOREIGN PATENT DOCUMENTS

| | | |
|---|---|---|
| 0712990 | 5/1996 | European Pat. Off. . |
| 1408963 | 7/1965 | France . |
| 2448022 | 8/1980 | France . |

*Primary Examiner*—Daniel P. Stodola
*Assistant Examiner*—Curtis A. Cohen
*Attorney, Agent, or Firm*—Shlesinger, Fitzsimmons & Shlesinger

[57] ABSTRACT

A gate movement drive comprises a motor movement unit (11) with linear-movement actuator and a sensing device (14) for detection of an angle which is a function of the gate position. The linear movement actuator (11) has its ends pivoted to respective supports (24,32) designed for fastening of the actuator between a fixed part and a wing of a gate which is pivoted to a rotation axis (23). The sensing device (14) is connected between the actuator and one of the supports (24,32) for detection of the angle of rotation between the actuator and the support.

5 Claims, 2 Drawing Sheets

GATE MOVEMENT DRIVE

BACKGROUND OF THE INVENTION

The present invention relates to an innovative gate movement drive.

In the prior art gate drives comprise a motor unit which moves the gate and an electrical/electronic circuit which controls the motor unit and supervises the opening and closing phases. In particular the control circuit receives gate opening and closing signals and actuates in a corresponding manner the motor unit usually for a time period which is predetermined to be sufficient to take the gate to the required condition. More rarely there is also provided a stop which is operated by the gate when it reaches the fully closed or open position in such a manner as to stop the motor unit upon actual achievement of the fully closed or open position. However closed or open stopping is achieved the gate always moves at maximum speed to the stop position and then always stops violently against the mechanical stops.

Some drives also have the capability of controlling the gate to move it to a predetermined intermediate position to provide a barrier against the entry of vehicles but permit foot traffic. This capability is usually afforded by providing an opening movement for a time assumed necessary to provide the desired passage. Unfortunately changes in the timing or speed of movement of the gate due to deterioration of the components, wear, changes in environmental conditions etcetera often make this function unreliable.

Lastly, some drives have sensors which measure the opening and closing effort and permit detection of obstacles to gate movement. When such a condition is detected the drive locks or reverses gate movement. But it has been noted that in some cases reversal of motion can be dangerous and especially in the case where the obstacle consists of a person trapped by moving parts of the gate. Even mere stopping suffers however from the shortcoming of often keeping the obstacle trapped between the gate and its stop striker.

Because of the widespread use of conventional drives as described above it is very difficult to develop alternative solutions which would be functionally satisfactory but at the same time compatible with the existing mechanical and electromechanical parts.

The general purpose of the present invention is to obviate the above mentioned shortcomings by making available a gate drive which would permit more accurate and steady gate movement control together with the capability of simplicity of mechanical installation of the parts peculiar to the new drive.

SUMMARY OF THE INVENTION

In view of this purpose it was sought to provide in accordance with the present invention a gate movement drive comprising a movement motor unit characterized in that it comprises a sensing device for detection of an angle as a function of the gate position with the motor unit comprising a linear movement actuator with ends pivoted to respective supports designed for fastening the actuator between a fixed part and a wing of a gate pivoted on a rotation axis with the sensing device being connected between the actuator and one of the supports for detection of the angle of rotation between the actuator and the support.

BRIEF DESCRIPTION OF THE DRAWINGS

To clarify the explanation of the innovative principles of the present invention and its advantages compared with the prior art there is described below with the aid of the annexed drawings a possible embodiment thereof by way of non-limiting example applying said principles. In the drawings.

DETAILED DESCRIPTION OF THE INVENTION

Figure 1:
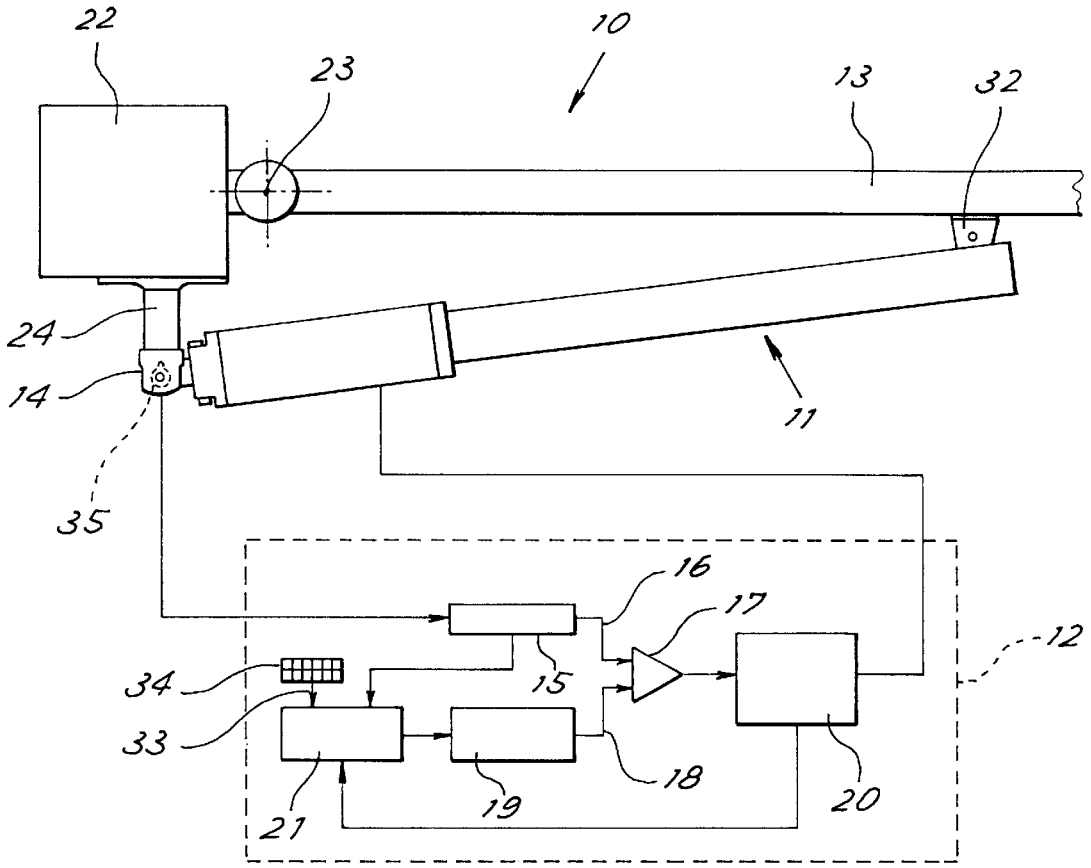
FIG. 1 shows a diagrammatic view of a gate with a drive produced in accordance with the innovative principles claimed here.

With reference to the figures FIG. 1 shows a drive indicated as a whole by reference number 10 for effecting movement of a gate 13. The actuator consists of a motor unit 11 (FIG. 2) having linear movement and a control unit 12. The gate can be of any type and have one or two wings. The drive comprises a position sensing device 14 which supplies a signal the magnitude of which is a function of the gate position as it is moved by the linear motor unit 11 between the extreme gate positions completely open and completely closed.

The gate 13 is mounted on pintles so as to rotate around a vertical axis 23 and the linear motor unit 11 is pivoted at opposite ends thereof on supports or brackets 24, 32. The bracket 24 is fixed to a stationary pillar 22 supporting the pintles while the bracket 32 is fixed to the wing gate 13.

On the pivoting between the motor unit and the bracket 24 is arranged the device 14 for measurement of the angle between the bracket 24 and the actuator or motor-unit 11. This angle is of course a function of the position of the gate around the rotation axis 23 and the sensor thus supplies a measurement of the gate position.

Figure 2:
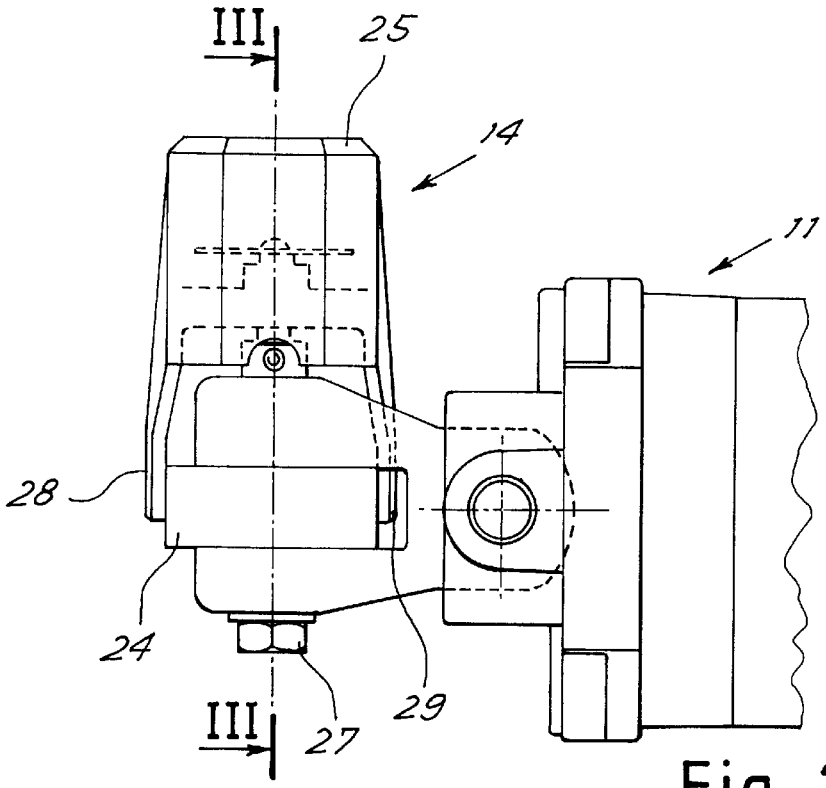
FIG. 2 shows a side elevation of part of the drive of FIG. 1.
Figure 3:
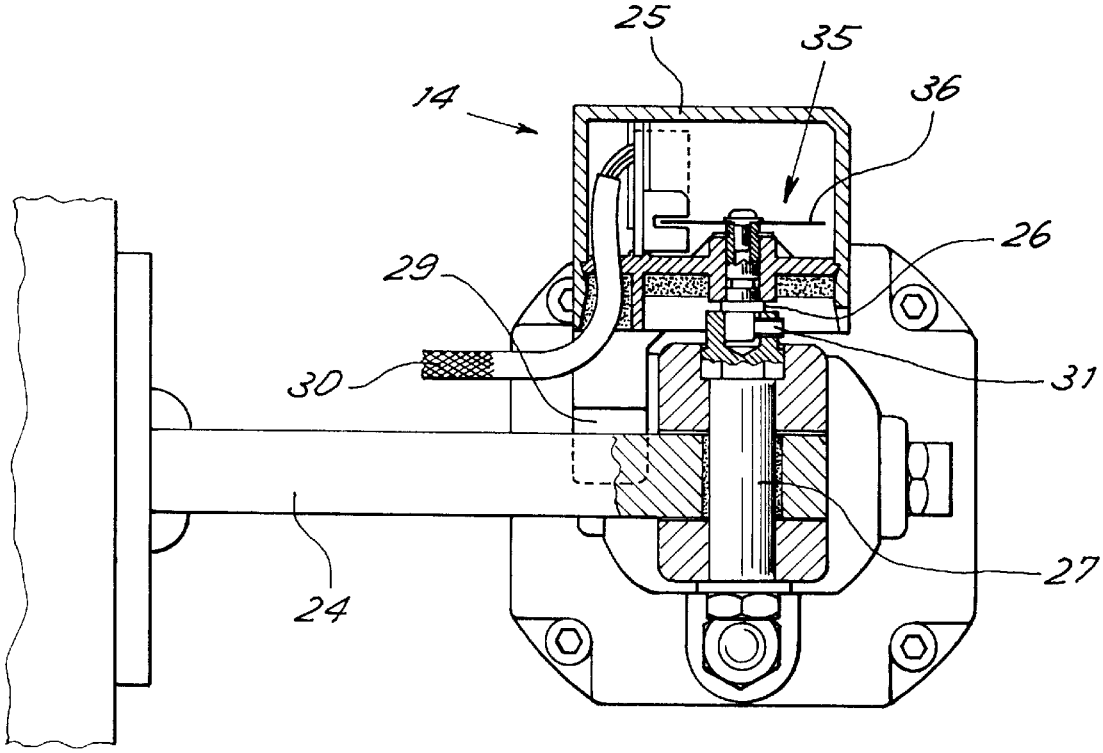
FIG. 3 shows a side elevation cross-sectioned along plane of cut III—III of FIG. 2.

As may be seen in FIGS. 2 and 3 the device 14 comprises a sealed container 25 from which emerges below a shaft 26 drivingly connected at one end to a sensing element 35 inside the container. For example the sensor 35 can be made up of an incremental encoder whose disc 36 is directly keyed onto the end of the shaft 26 in the container.

The shaft 26 has its opposite end projecting from the container and is connected for example by a security dowel 31 to the head of the pin 27 which is pivotal in stationary braket 24 and constitutes the hinging between the motor unit and the bracket. The pin 27 is integral with or secured to the end of the motor unit remote from bracket 32. Advantageously the shaft also constitutes a support for the container 25 and its contents. The device 14 constitutes a sensor unit easy to mount even on a prior art motor unit possible already installed on a gate. To avoid rotation of the entire sensor unit 14 the container 25 has taps 28, 29 which embrace the bracket 24 laterally.

The sensor device is connected to the control unit 12 through an electric cable 30 (FIG. 3) emerging in a sealed manner from the container bottom.

As may be seen in FIG. 1 the unit 12 can include a circuit 15 for processing the signal sent to it by the sensor unit 14 to secure a signal 16 representing the gate position. A comparator 17 compares the signal 16 with a reference signal 18 supplied by a comparison memory 19 and controls a control circuit 20 for the motion of the motor unit. The reference signal is memorized in the memory 19 by means of a memorization circuit 21 which chooses this value from among a plurality comprising for example the values corresponding to gate closed, open, in intermediate position etcetera. The memorization circuit can receive control signals 33 for the previous memorization of the plurality of values to be used during use of the gate. The signals 33 can for example be produced through a keyboard 34 or other known data entry means even computerized such as a suitable external programmer. There has been found advantageous a self-learning procedure in which the gate is positioned in the position to be memorized for example the position of end stop, intermediate stop etcetera then sending the memorization signal 33 of the corresponding value at that moment detected by the sensor.

Advantageously the signals 16 and 18 can be digital signals with several bits. For example the sensor could be an incremental optical, magnetic etcetera encoder and the processing circuit 15 could be a forward-backward contactor supplying at its output 16 a binary number representing the gate position instant by instant. The memory 19 will therefore be a digital memory.

The memorization device could act on request of control means such as an open-close remote control or a key switch or other known means readily imaginable by one skilled in the art.

Thanks to the sensor the control unit can control the gate movement, its position and if necessary its speed. For gate movement up to its fully closed or open position the memorization device 21 memorizes in the memory 19 the value which must be reached on the output 16 and which corresponds to the fully closed or open position. The control circuit 20 pilots the motor unit 11 until the comparator 17 signals that the counting outputs 16 and reference outputs 18 are equal. Upon nearing the stop position the control circuit can slow the gate until a gentle stop is achieved.

Similarly, to reach any desired partially open position the memorization circuit 21 memorizes in the memory 19 the value corresponding to that position. The control circuit 20 thus operates the motor unit until this value is reached on the output 16. In this manner it is certain to always reach a desired position in a repeatable manner.

If an obstacle obstructs gate movement and stops or slows it the comparator 17 can notice that the speed with which the position signal 16 tends to reach the reference signal 18 has fallen below a threshold which is predetermined to be the minimum acceptable. The comparator signals the irregular condition to the control circuit 20 which can thus command the motor unit to face this condition. The control circuit can act in various ways. For example it can merely stop the gate movement or it can command reversal of gate movement to a stop position as is usually done in the prior art. As an alternative it can be provided that the gate movement be reversed to have the gate make a small predetermined movement before stopping it. This last action was found very advantageous because it permits withdrawing the gate from the obstacle and liberating it without the risk of dragging the obstacle. This is very important if the obstacle is a person caught in the moving gate.

The entire functionality of the control unit 12 can be integrated in an appropriate microprocessor circuit appropriately programmed so as to provide a small economical unit.

At this point it is clear that the preset objectives have been achieved by making available an accurate safe reliable movement drive. The sensor device can be installed simply by engaging it on a pin of the movement unit. It its evident that installation of a drive in accordance with the present invention is extremely simple and economical and that even a conventional drive already installed can be replaced rapidly simply by adding the sensor and the control unit 12.

Naturally the above description of an embodiment applying the innovative principles of the present invention is given by way of non-limiting example of said principles within the scope of the exclusive right claimed here.

For example the drive could also include further elements known in conventional gate drives such as photoelectric cells, contact sensors, radio control receivers etcetera.

If the encoder is the relative rather than the absolute type there can be provided an initialization sensor starting from a predetermined position for example corresponding to the fully closed gate. The position sensor 14 could be also mounted to measure the rotation of the actuator in relation to the support 32.

What is claimed is:

1. A gate movement drive comprising a motor unit disposed to be connected to a gate which is pivotal about a rotation axis relative to a stationary fixture, a sensor device for detection of an angle which is a function of the gate position about said rotation axis with respect to the motor unit, said unit comprising a linear movement actuator having its opposite ends pivoted about a pair of supports designed for fastening of the actuator between said stationary fixture and said gate, and said sensor device being interposed between the actuator and one of the supports for detection of the angle of rotation between the actuator and the one support, the sensor device comprising a rotation sensor housed in a container from which projects a shaft for effecting rotation of the sensor, and with the shaft having means of connection to a rotatable pin which rotates through an angle which is a function of the position of the gate, said sensor device including taps projecting from the container to interfere with a rotatable support part of the rotatable pin and making the container non-rotating with respect to said support part.

2. A drive in accordance with claim 1 characterized in that the sensor device is connected to the actuator opposite by said rotatable pin forming a rotating connection of the actuator to said one of the supports.

3. A drive in accordance with claim 1 characterized in that the sensor device is supported by the shaft.

4. A drive in accordance with claim 1, including an electronic control unit for the motor unit with the electronic unit comprising a comparator and a memory and the comparator comparing a position signal supplied by the sensor device with a corresponding reference signal previously memorized in the memory and operatively sending commands to the motor unit as a function of the result of the comparison.

5. A drive in accordance with claim 4 characterized in that the control unit comprises memorization means memorizing in said memory a predetermined reference signal chosen from among a plurality of reference signals.

* * * * *